United States Patent [19]

Ravnsborg et al.

[11] Patent Number: 4,688,981

[45] Date of Patent: Aug. 25, 1987

[54] LOW LOAD LIFT ADAPTER

[76] Inventors: Jerry K. Ravnsborg, 10311 W. St., Omaha, Nebr. 68127; John C. Troy, 15274 Cuming St., Omaha, Nebr. 68154

[21] Appl. No.: 771,907

[22] Filed: Sep. 3, 1985

[51] Int. Cl.[4] ..... B66F 9/06

[52] U.S. Cl. ..... 414/607; 414/785; 414/608

[58] Field of Search ..... 414/607, 785, 667, 912, 414/608

[56] References Cited

U.S. PATENT DOCUMENTS 3,232,380 2/1966 Hansen ..... 414/667 X 4,290,729 9/1981 Cary ..... 414/785 X 4,395,188 7/1983 Kaup ..... 414/667 X

*Primary Examiner*—Robert J. Spar

*Assistant Examiner*—Stuart J. Millman

*Attorney, Agent, or Firm*—Zarley, McKee, Thomte, Voorhees & Sease

[57] ABSTRACT

A low load lift adapter designed for use with a forklift truck comprising an upper frame adapted to be secured to the teeth of the forklift and having a vertically disposed frame section extending downwardly from the forward end thereof. A pair of spaced-apart pocket members are secured to the lower end of the vertically disposed frame and are adapted to removably receive a pair of fork teeth therein.

1 Claim, 10 Drawing Figures

LOW LOAD LIFT ADAPTER

BACKGROUND OF THE INVENTION

This invention relates to a low load lift adapter and more particularly to a low load lift adapter for a forklift truck or the like.

Forklift trucks or "forklifts" normally include a wheeled frame means having a vertically disposed mast at the forward end thereof upon which a carriage vertically moves. A pair of spaced-apart fork teeth or forks are mounted on the carriage and are designed to engage the underside of pallets or the like which normally have the load to be transported positioned thereon. The forklift is maneuvered so that the forks engage the pallet and the carriage is then moved upwardly on the mast so that the load is lifted from the ground. Although the forklifts are able to lift the loads to considerable heights, the forklifts are unable to lower the loads much below ground level. A problem is therefore encountered when the forklifts are being utilized to transport materials from a loading dock onto a truck which has a bed positioned considerably below the level of the loading dock.

It is therefore a principal object of the invention to provide a low load lift adapter for a forklift truck.

A further object of the invention is to provide a low load lift adapter for a forklift which enables the forklift to lower loads considerably below the level of a loading dock.

Yet another object of the invention is to provide a low load lift adapter which includes a pair of removable fork teeth mounted thereon.

A further object of the invention is to provide a low load lift adapter including removable fork teeth thereon including means for automatically locking the same in their respective pockets.

Still another object of the invention is to provide a low load lift adapter for a forklift truck which is durable in use and refined in appearance.

These and other objects will be apparent to those skilled in the art.

SUMMARY OF THE INVENTION

Figure 1:
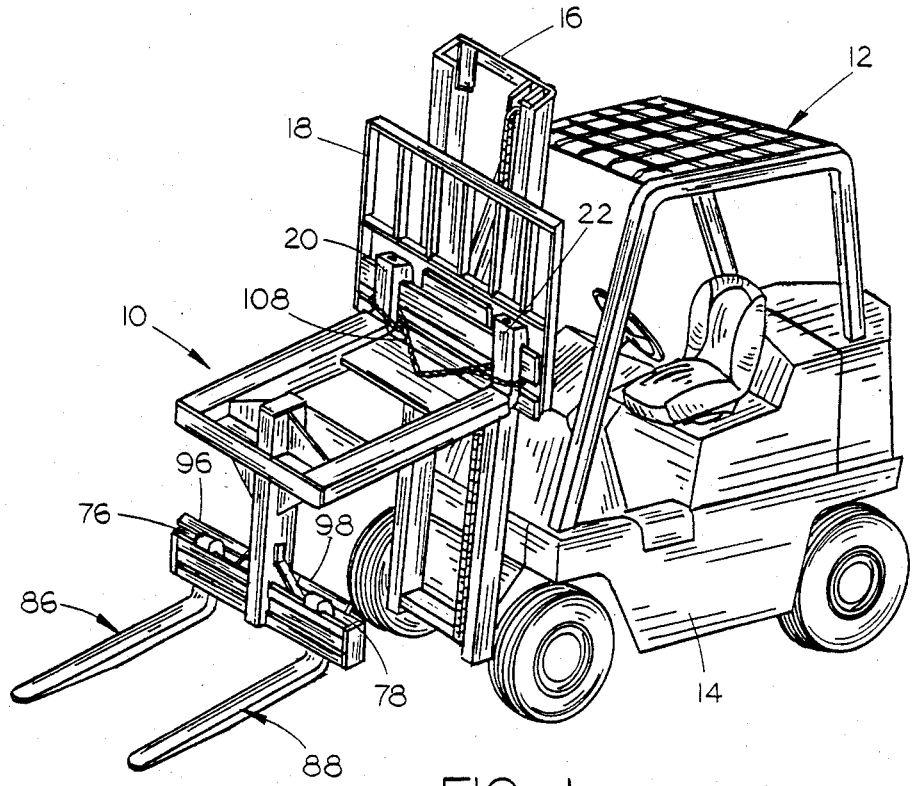
FIG. 1 is a front perspective view illustrating the adapter of this invention mounted on a forklift.
Figure 2:
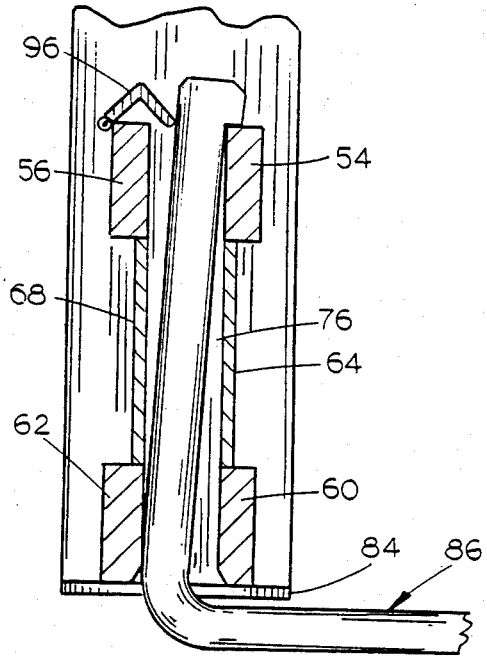
FIG. 2 is a sectional view illustrating the manner in which the forks of the adapter are mounted therein.
Figure 3:
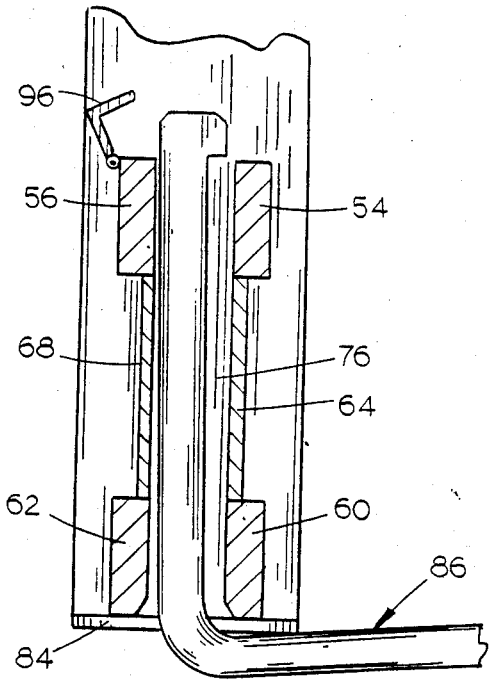
FIG. 3 is a view similar to FIG. 2 except that the locking device has been moved to an unlocked position.
Figure 4:
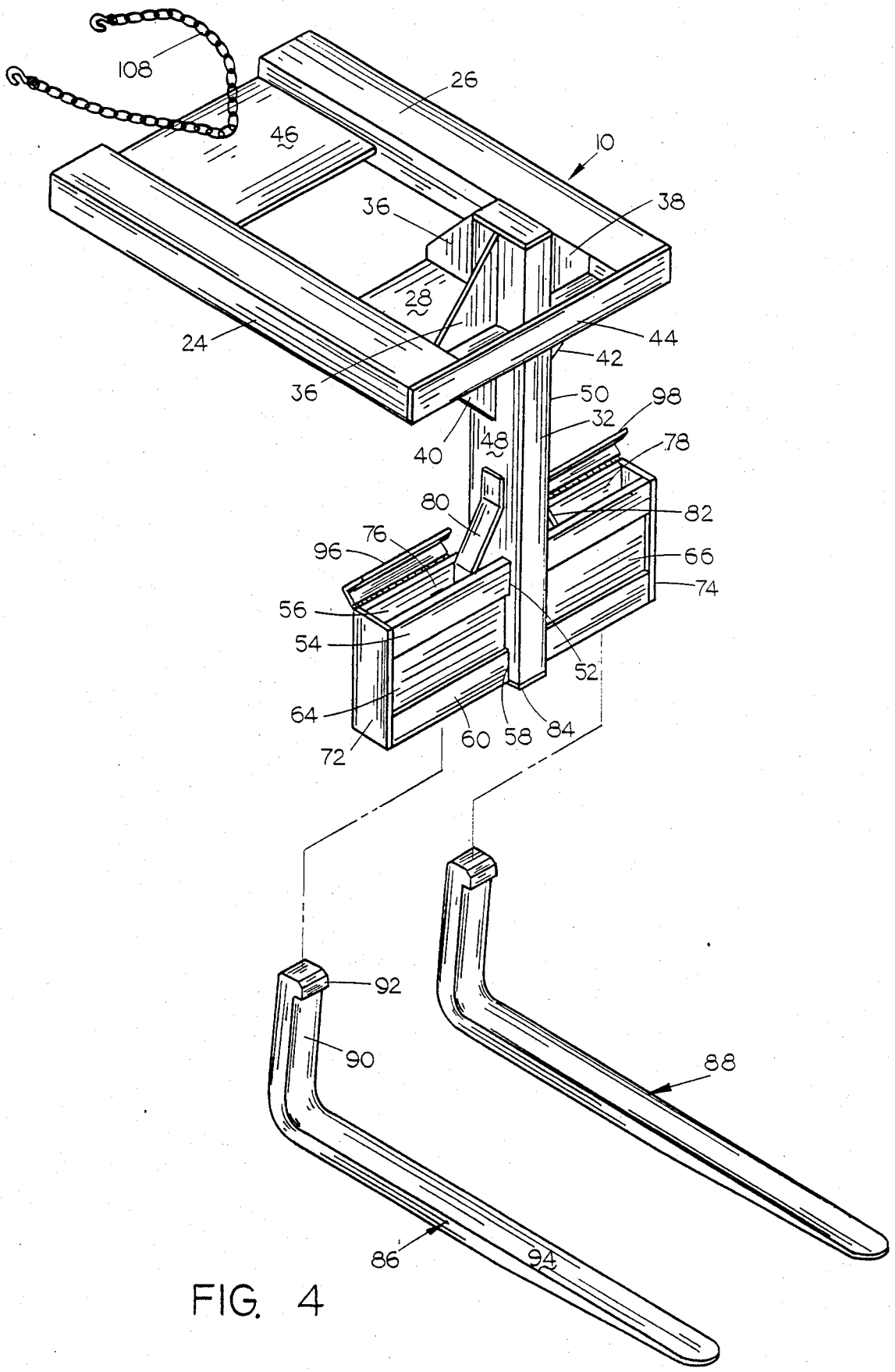
FIG. 4 is an exploded perspective view of the adapter of this invention.
Figure 7:
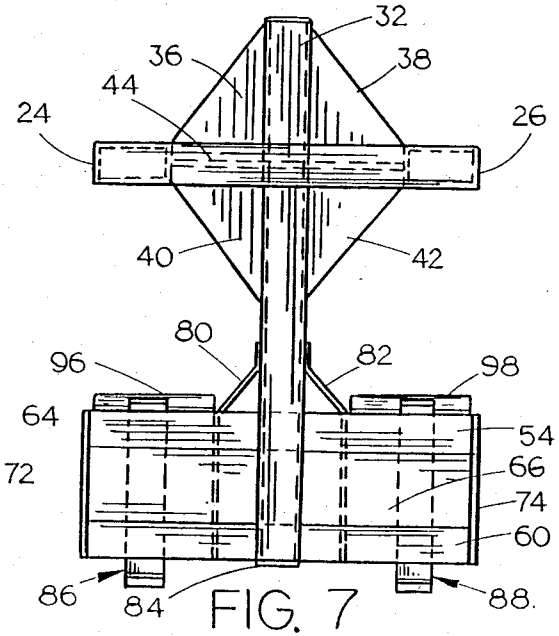
FIG. 7 is a front elevation of the adapter of this invention.
Figure 5:
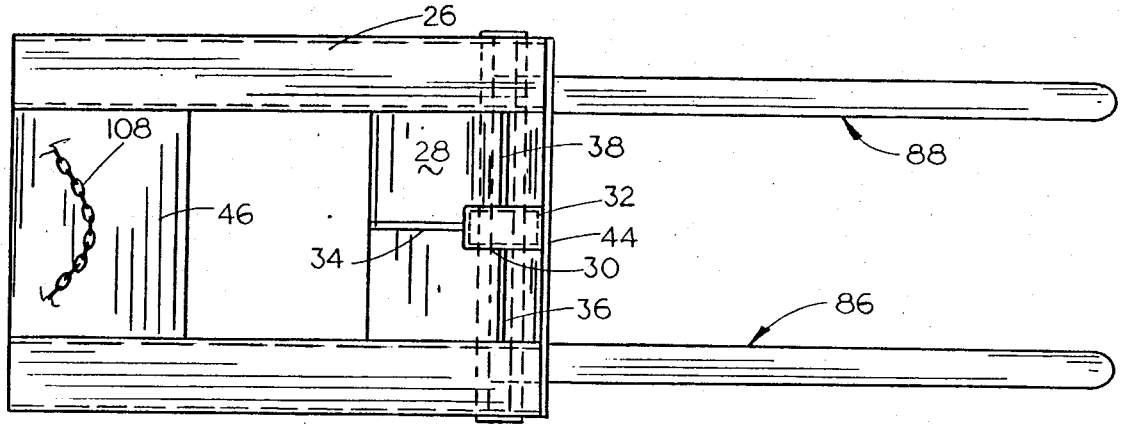
FIG. 5 is a top elevational view of the adapter of this invention.
Figure 6:
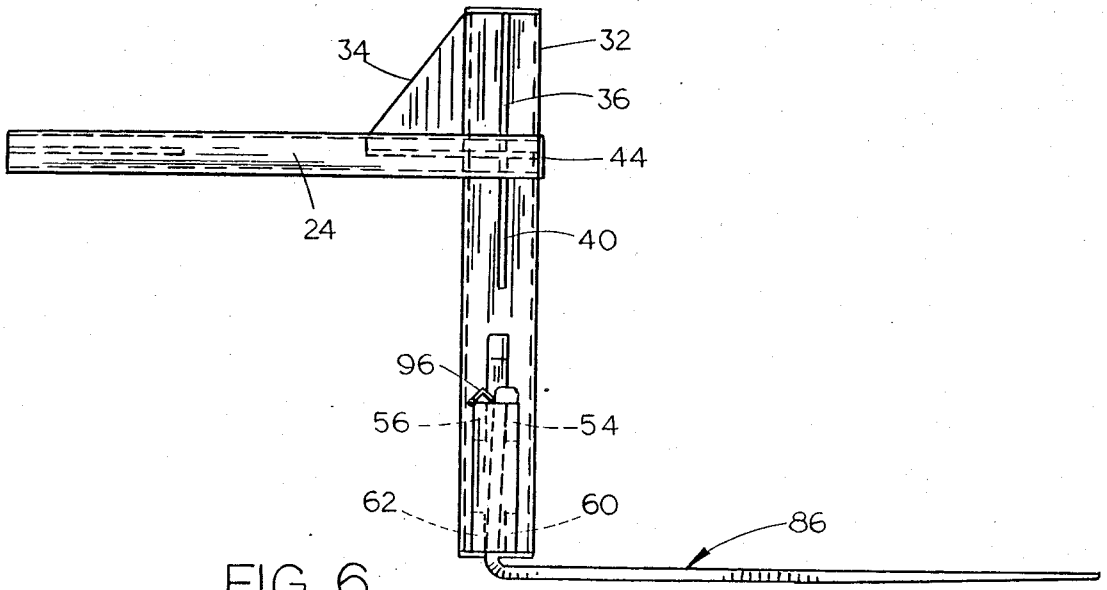
FIG. 6 is a side view of the adapter of this invention.
Figure 8:
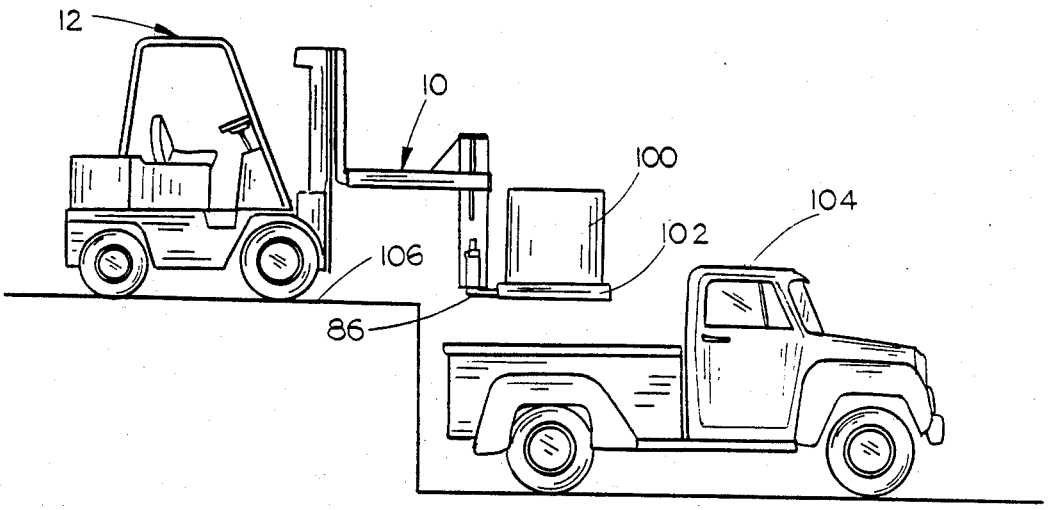
FIGS. 8–10 illustrate the manner in which the adapter of this invention may be utilized.
Figure 9:
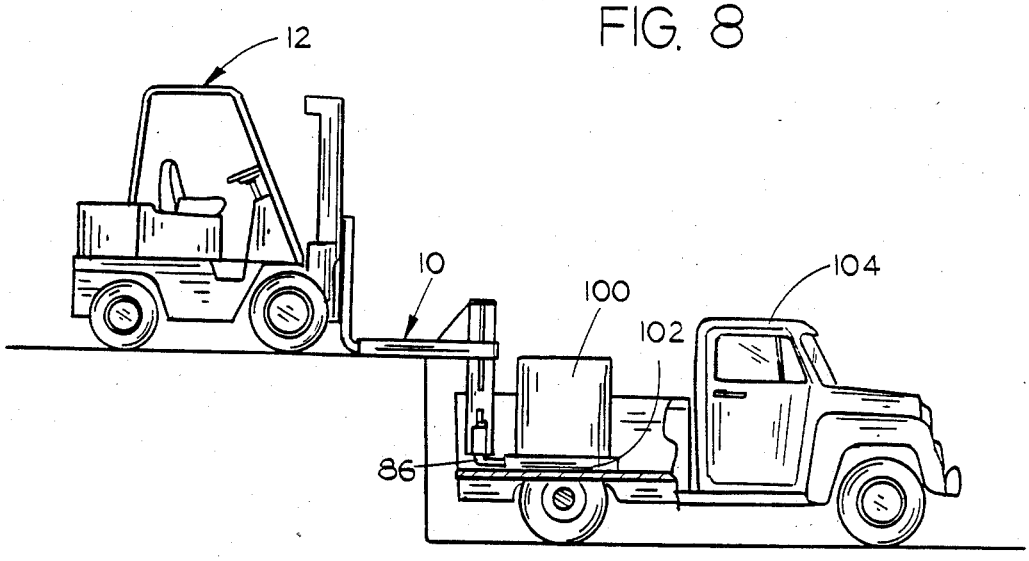
Figure 10:
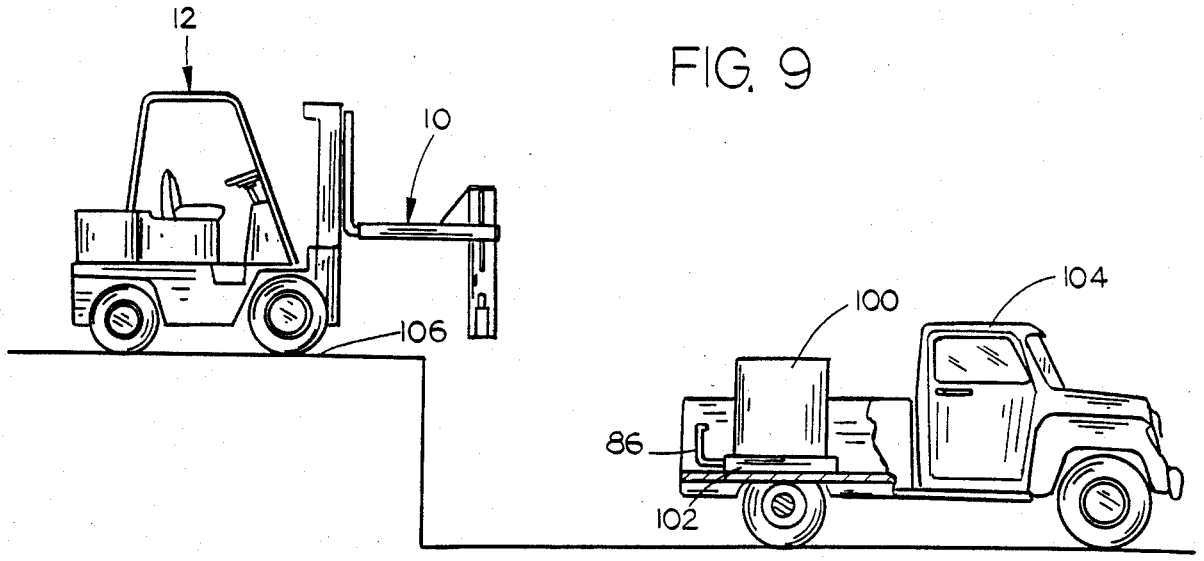

The low load lift adapter of this invention comprises a pair of horizontally disposed and horizontally spaced-apart hollow tubular members which are adapted to be removably positioned on the forks of a forklift truck. The tubular members extend forwardly from the forklift truck and have a vertically disposed support secured to the forward end thereof which extends downwardly therefrom. A pair of spaced-apart pocket members are secured to the lower end of the vertically disposed support and are adapted to removably receive a pair of fork teeth therein. Means is also provided for automatically locking the fork teeth in their respective pockets.

When it is desired to lower a load below loading dock level, the adapter is mounted on the fork teeth of the load lift. The forklift is maneuvered so that the teeth of the adapter are received by the pallet. The carriage on the forklift truck is then raised so that the load is lifted from its supporting surface. The forklift truck is then driven to the edge of the loading dock and the carriage lowered. The adapter extends downwardly and outwardly from the forks of the forklift truck forwardly and below the loading dock to enable the load to be positioned on the bed of a truck or the like.

DESCRIPTION OF THE PREFERRED EMBODIMENT

The adapter of this invention is referred to generally by the reference numeral 10 while the numeral 12 refers to a conventional forklift truck or forklift including wheeled frame means 14 having a vertically disposed mast 16 at the forward end thereof. A carriage 18 is vertically movably mounted on the mast 16 and has a pair of fork teeth or forks 20 and 22 mounted thereon.

Adapter 10 includes a pair of horizontally disposed and horizontally spaced rectangular tubular members 24 and 26 having rearward and forward ends. Plate 28 is secured to and extends between the forward ends of tubular members 24 and 26 as seen in the drawings and has a cut-out portion 30 provided at its forward end. A vertically disposed rectangular tubular member or support 32 is positioned in the cut-away portion 30 and has its upper end disposed above the tubular members 24 and 26 as illustrated in the drawings. Gusset plates 34, 36, 38, 40 and 42 are welded in the position illustrated in the drawings to add strength to the assembly. The forward ends of tubular members 24 and 26 are preferably closed by bars 44. Plate 46 is secured to and extends between tubular members 26 and 28 at the rearward ends thereof.

The side walls 48 and 50 of tubular member 32 are provided with a pair of openings 52 formed therein through which extend bars 54 and 56. The side walls 48 and 50 of tubular member 32 are also provided with a pair of notches 58 formed therein which receive the bars 60 and 62. Bars 54, 56, 60 and 62 are welded to the tubular member 32 in conventional fashion.

Plate 64 is welded to and extends between bars 56 and 62 at one side of tubular member 32 while plate 66 is welded to and extends between bars 56 and 62 at the other side of tubular member 32. Similarly, plates 68 and 70 (not shown) are welded to and extend between the bars 54 and 60. Plates 72 and 74 are welded to the opposite ends of the bars 54, 56, 60 and 62 to create pockets 76 and 78 at opposite sides of the tubular member 50. As seen in the drawings, the lower ends of bars 60 and 62 are tapered to facilitate the positioning of fork teeth therein as will be described in more detail hereinafter. As seen in the drawings, brackets or bars 80 and 82 are secured to tubular member 50 at opposite sides therein and extend downwardly between the bars 54–56 and 60–62. Thus, pocket 76 is defined as being that space between the inside surface of plate 72 and the outer surface of bracket 80 between the bars 54–56 and 60–62. Similarly, pocket 76 is defined as that space inwardly of plate 74 and outwardly of bracket 82 between the bars 54–56 and 60–62. Preferably, the lower end of tubular member 32 is closed by means of plate 84.

The pockets 76 and 78 are adapted to receive forks 86 and 88 therein as will now be described. Each of the forks 86 and 88 include an upstanding back portion 90 having a forwardly extending dog 92 at the upper end thereof. Each of the forks 86 and 88 also include a forwardly extending portion 94. The angle between back portion 90 and forwardly extending portion 94 is slightly less than 90°. The numerals 96 and 98 refer to locking members which are pivotally connected to the upper ends of bars 54 at opposite sides of tubular member 50. The upper rearward pivotal movement of the locking members 96 and 98 are limited by the brackets 80 and 82. As seen in the drawings, the upper ends of the back portions 90 are tapered to facilitate their entry into the bottoms of the pockets 76 and 78.

In use, assuming that a load 100 is mounted on a pallet 102, with the empty pickup truck 104 being positioned adjacent the loading dock 106 with its end gate lowered, the forklift operator will position the adapter 10 on the forks 20 and 22 of the forklift truck 12 so that tubular members 24 and 26 receive the teeth 20 and 22 respectively. It is recommended that a safety chain 108 or the like be extended between the adapter and the carriage 18 to positively maintain the adapter on the forklift truck. The forklift operator maneuvers the forklift until the teeth 86 and 88 are received by the pallet 102. The carriage 18 is then raised on the mast 16 to raise the pallet 102 from its supporting surface. The forklift 12 is then driven to the edge of the loading dock so that the pallet 102 is positioned outwardly of the edge of the loading dock and over the bed of the pickup truck 104. The carriage 18 is then lowered until the pallet 102 rests on the bed of the truck. Since it is impossible to move the forklift rearwardly sufficient to withdraw the teeth 86 and 88 from the pallet 102, the locking devices 96 and 98 are pivoted rearwardly. The forklift 12 is then maneuvered so that the dogs 92 are moved out of engagement with the upper ends of the bar 56. Carriage 18 is then raised which causes the adapter 12 to move vertically upwardly relative to the forks 86 and 88 which remain beneath the pallet. The truck 104 may then be driven forwardly so that the forks 86 and 88 can be manually pulled from the pallet 102. The end gate of the truck 104 would then be closed.

When it is desired to re-position the forks 86 and 88 in the pockets 76 and 78, respectively, the forks 86 and 88 are simply positioned on a supporting surface in the approximate desired spaced-apart position. The forklift 12 is maneuvered until the pockets 76 and 78 are positioned over the upper ends of the back portions 90 of the forks 86 and 88. The carriage 18 is then lowered so that the upper ends of the back portions 90 of the forks 86 and 88 are received by the pockets 76 and 78. The entry of the teeth into the pockets is enhanced by the tapered upper end of the teeth and the tapered lower ends of the bars 60 and 62. As the pockets 76 and 78 are lowered relative to the teeth, the upper ends of the teeth will cause the locks 96 and 98 to pivot upwardly and rearwardly. When dogs 92 are positioned above bar 56, the truck 12 is maneuvered slightly to cause the dogs 92 to move forwardly over bar 76. The forks 86 and 88 are maintained in position in the pockets by the action of the locking devices 96 and 98.

When it is desired to remove a load from the pickup truck 104, the procedure just described would be reversed. Thus it can be seen that a novel adapter has been provided which enables a forklift truck to position loads on a truck or the like wherein the bed of the truck is considerably lower than the loading dock. It can therefore be seen that the adapter of this invention accomplishes at least all of its stated objectives.

We claim:

1. A low load lift adapter for a forklift truck comprising, spaced-apart first and second horizontally disposed elongated hollow tubular members having rearward and forward ends, the rearward ends of said tubular members being open for receiving the teeth of the forklift truck, a vertically disposed support member secured to and connecting the forward ends of said first and second tubular members and extending downwardly therefrom, a pair of horizontally spaced and vertically disposed pocket members mounted on opposite sides of the lower end of said vertically disposed support member, each of said pocket members having a forward face with an upper edge, and a rearward face, said forward and rearward faces spaced apart so as to form a pocket, each of said pocket members having open upper and lower ends, said forward and rearward faces of said pocket members having their lower ends tapered so as to create a larger opening between said forward and rearward faces at the lower end of said pocket members, first and second fork members, each having an upstanding back portion and a lower portion which extends forwardly from the lower end of each said back portion, said back and lower portions being disposed at an angle less than 90 degrees with respect to one another, said back portions of said fork members being vertically removably receivable in said pocket members, said fork members having a forwardly extending dog on the upper end of said back portions, each said dog forming a forwardly extending lip adapted to catch on the upper edge of the forward face of said pocket member, said back portions of said fork members being laterally movable within said pocket members, said dogs on said back portions being slidable along the upper edge of said forward faces, said back portions of said fork members having tapered upper ends so as to form a slightly narrower portion thereon, whereby said back portions are easily received within the open lower end of said pocket members and guided upwardly through said pocket members to rest the lip of each said dog on the upper edge of each said forward face, and, wedge means removably inserted between the rearward face of each said pocket member and the back portion of each said fork member within each said pocket member, said wedge means adapted to selectively maintain the lip of each said dog on the upper edge of said forward faces of said pocket members.

* * * * *